US005342260A

United States Patent [19]

Markland

[11] Patent Number: 5,342,260

[45] Date of Patent: Aug. 30, 1994

[54] BUMPER ATTACHMENT ASSEMBLY FOR LATERAL MOVEMENT TRAINER

[75] Inventor: Max C. Markland, Gresham, Oreg.

[73] Assignee: Joshua Group Ltd., Portland, Oreg.

[21] Appl. No.: 925,988

[22] Filed: Aug. 6, 1992

[51] Int. Cl.[5] ..... A63B 21/00

[52] U.S. Cl. ..... 482/51; 482/148; 482/13; 434/253

[58] Field of Search ..... 482/51, 54, 148, 146, 482/13, 51; 472/90, 118; 434/253

[56] References Cited

U.S. PATENT DOCUMENTS

| | | | |
|---|---|---|---|
| D. 321,918 | 11/1991 | Blanchard . | |
| 2,842,365 | 7/1958 | Kelley . | |
| 3,468,536 | 9/1969 | Minshull et al. . | |
| 3,497,211 | 2/1970 | Nagin . | |
| 3,508,945 | 4/1970 | Haemer et al. . | |
| 3,756,595 | 9/1973 | Hague . | |
| 4,169,688 | 10/1979 | Toshio . | |
| 4,340,214 | 7/1982 | Schutzer . | |
| 4,438,003 | 3/1984 | Nathaniel et al. . | |
| 4,548,405 | 10/1985 | Lee et al. | 482/54 |
| 4,779,862 | 10/1988 | Keppler . | |
| 4,923,192 | 5/1990 | Sawdon . | |
| 4,940,226 | 7/1990 | Carra . | |
| 5,052,682 | 10/1991 | Croce, Jr. et al. . | |
| 5,076,571 | 12/1991 | Croce, Jr. et al. . | |
| 5,114,387 | 5/1992 | Keppler . | |
| 5,133,700 | 7/1992 | Braathen | 482/51 |

FOREIGN PATENT DOCUMENTS

| | | | |
|---|---|---|---|
| 0304008 | 2/1989 | European Pat. Off. | 472/90 |
| 2266439 | 10/1975 | France | 472/90 |
| 0602198 | 4/1978 | U.S.S.R. | 482/51 |

*Primary Examiner*—Stephen R. Crow
*Assistant Examiner*—Jerome Donnelly
*Attorney, Agent, or Firm*—Kolisch Hartwell Dickinson McCormack & Heuser

[57] ABSTRACT

A bumper-attachment assembly is disclosed for attaching to an elongate slideboard of a lateral movement trainer a bumper which includes an inner region with an impact surface, and outer, bottom and top regions. The assembly includes slideboard-receiving structure formed with a groove which is positioned in the bottom region at an angle of about 15°–30° that slopes upwardly with respect to a plane containing a bottom surface of the bottom region and away from the impact surface. The assembly also includes slideboard-fastening structure positionable adjacent the slideboard-receiving structure and operative to fasten a first end of the slideboard to the bottom region. The assembly also includes a protective-decorative covering for the bottom region, and which may be structured to cover the top, inner and outer regions of the bumper.

9 Claims, 3 Drawing Sheets

BUMPER ATTACHMENT ASSEMBLY FOR LATERAL MOVEMENT TRAINER

BACKGROUND OF THE INVENTION

The present invention relates to exercise equipment known as lateral movement trainers (LMTs), and more particularly to a bumper attachment assembly for LMTs.

An LMT allows a user to exercise certain muscles by simulating the movements of a speed skater. It is known in the exercise-equipment field to construct an LMT with a smooth elongate slideboard that includes a bumper attached to each end. The user pushes off from a first bumper using a sideways leg motion, and slides to a second bumper at the opposite end of the slideboard. The user then pushes off from that other bumper and slides back to the first bumper. This back-and-forth movement is repeated to exercise the glutei and adductor muscles, as well as the quadriceps and hamstrings.

It is also known to make flexible, portable LMTs in which the LMT is constructed with a flexible slideboard that has a block-shaped bumper attached at each end. The flexible slideboard allows the LMT to be rolled into a relatively small, tubular shape for transporting it. Each bumper of the LMT is attached to the slideboard by sandwiching the latter between a metal pressure plate and the flat bottom of the bumper.

When the LMT is unrolled for use, the flat bottom of the bumper lies in a plane parallel to the flattened bottom surface of the slideboard. To properly use the bumpers during training, the desired positioning of each is with their inner surface normal to a plane containing the slideboard.

However, after extended use of such a conventional LMT, the bumpers and slideboard do not remain in their desired orientation, i.e. the inner surface of each bumper becomes canted outwardly. This is a problem because without the inner surface of the bumper normal to the slideboard the athlete cannot properly push off from the bumper to begin sliding back to the opposing bumper. The canted position occurs because the force exerted on the bumpers by the athlete during training cause the slideboard to flex upwardly underneath the bumpers. This flexing causes the bumper to rock outwardly and rest on its outer edge. The result is that the inner surface of the bumper is oriented at an angle greater than 90° with respect to the slideboard. In addition, the section of the slideboard that is adjacent and inner of the bumper flexs upwardly. This is bothersome for the user, and also substantially reduces, if not negates, the utility of the LMT.

A second problem with such a conventional LMT occurs when it is used on wood floors, which is common because LMTs are frequently used on parquet and other wood floors at health clubs during aerobics classes. When the athlete trains on the LMT, the bottom outer surfaces of the device put nicks and scratches in the floor because the metal pressure plate under each bumper is in direct contact with the floor. As noted above, the pressure plate is positioned below the bottom surface of each bumper and is used in attaching the bumper to the slideboard. Screws are driven through holes in the plate and slideboard, and into the bumper.

Others have proposed flexible slideboards with a complex arrangement of wedges and weights positioned adjacent each bumper like the slideboard shown in Carra, U.S. Pat. No. 4,940,226. Carra's slideboard does not overcome the above-identified problems and introduces a new one, i.e. the slideboard curls up at one end when one bumper is adjusted to a desired position. An outer weight must be used to prevent the curling from happening.

Nowhere in the prior art is there shown or suggested to construct a portable LMT with bumpers that remain in their desired position normal to the slideboard when the LMT is unrolled for use. Further, there are no conventional proposals for constructing bumper attachment assemblies for LMTs that do not nick and scratch wood or other floors during use.

Accordingly, it is a general object of the present invention to provide a bumper attachment assembly for LMTs that overcomes the drawbacks of prior art assemblies.

Another object is to provide such a bumper attachment assembly that tends to maintain the inner surface of each bumper in the desired position normal to the slideboard.

A still further object is to provide such a bumper attachment assembly that does not adversely affect wood or other floors when the LMT is used.

Another object is to provide a portable LMT that is attractive in appearance.

Yet another object of the invention is to provide a portable LMT that is durable.

Another object is to provide such a bumper attachment assembly that can be manufactured easily and cost-effectively.

SUMMARY OF THE INVENTION

The preferred embodiment of the invention is a bumper-attachment assembly for attaching to an elongate slideboard of a lateral movement trainer a bumper which includes an inner region with an impact surface, and outer, bottom and top regions. The invention includes slideboard-receiving structure formed in the bottom region at an angle that slopes upwardly with respect to the bottom region and away from the impact surface. Slideboard-fastening structure is also provided and is positionable adjacent the slideboard-receiving structure and operative to fasten a first end of the slideboard to the bottom region.

The slideboard-receiving structure is preferably formed with a groove in the bottom region, which is at an angle of about 15°–30° sloping upwardly from a plane containing the bottom surface of the bottom region.

The invention also includes a protective-decorative covering for the bottom region. The covering includes a first edge for inserting in the slideboard-receiving structure between the slideboard-fastening structure and the bottom of the slideboard to fix the position of the first edge when the bumper is attached to the slideboard. The remainder of the covering is structured for folding back over the bottom region and further includes a fastener for fixing it to the bumper.

The invention also includes a protective-decorative cap that is structured to cover the top, inner and outer regions of the bumper.

These and additional objects and advantages of the present invention will be more readily understood after consideration of the drawings and the detailed description of the preferred embodiment.

DETAILED DESCRIPTION OF THE PREFERRED EMBODIMENT

Figure 1:
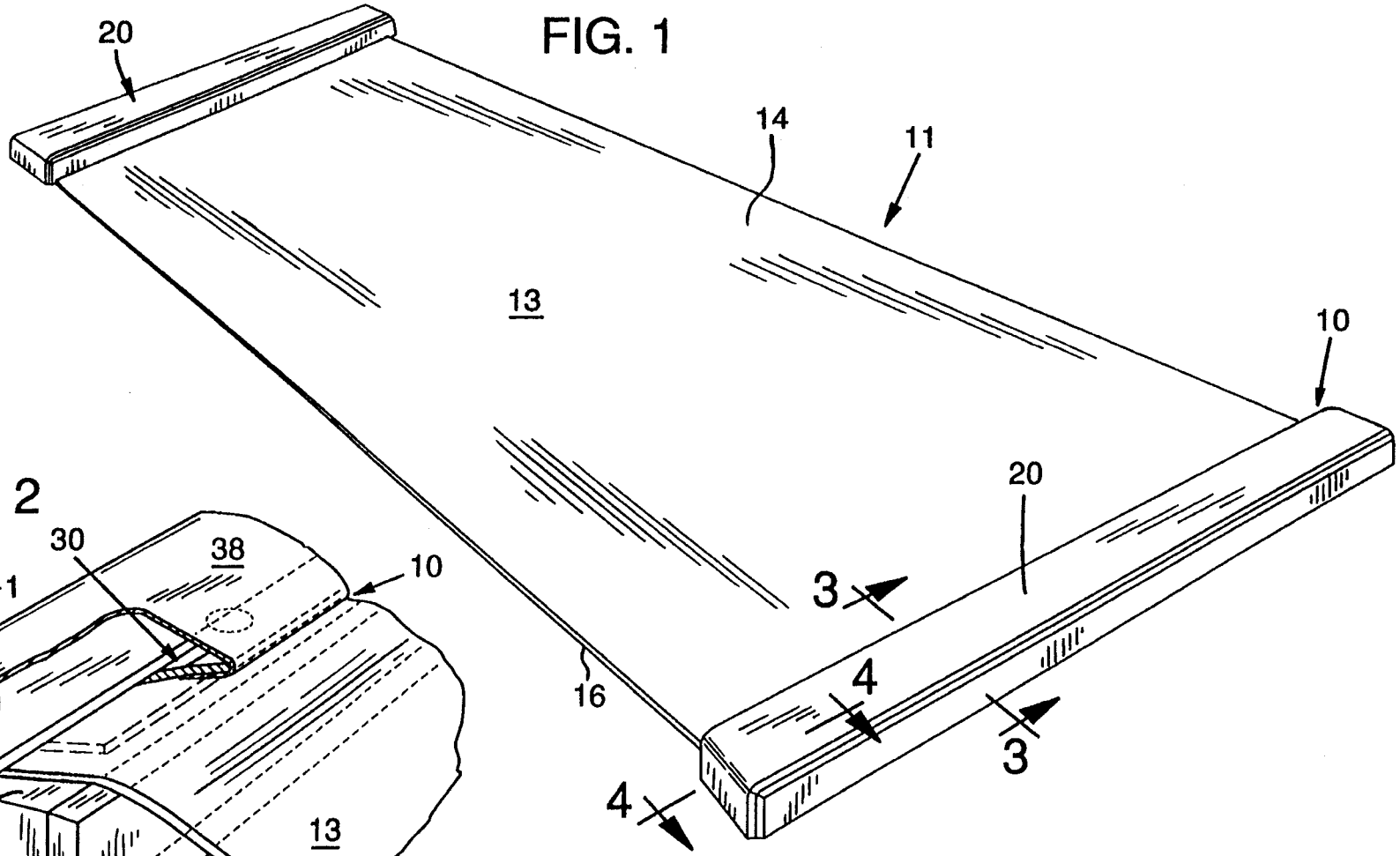
FIG. 1 is a perspective view of a lateral movement trainer (LMT) made with the preferred embodiment of the bumper-attachment assembly of the present invention.

Referring to FIG. 1, the bumper attachment assembly of the present invention is shown generally at 10 as part of an LMT 11 that rests on a floor 12 (Fig. 3) when the LMT is unrolled for use. Before describing further details of the assembly of the invention, certain portions of LMT 11 will be described to provide a context for the invention. The LMT includes an elongate slideboard 13, which preferably includes a flexible slide sheet 14 and a non-skid pad 16. Sheet 14 is preferably manufactured from high density polyethylene and pad 16 is preferably manufactured from a suitable rubber.

Figure 2:
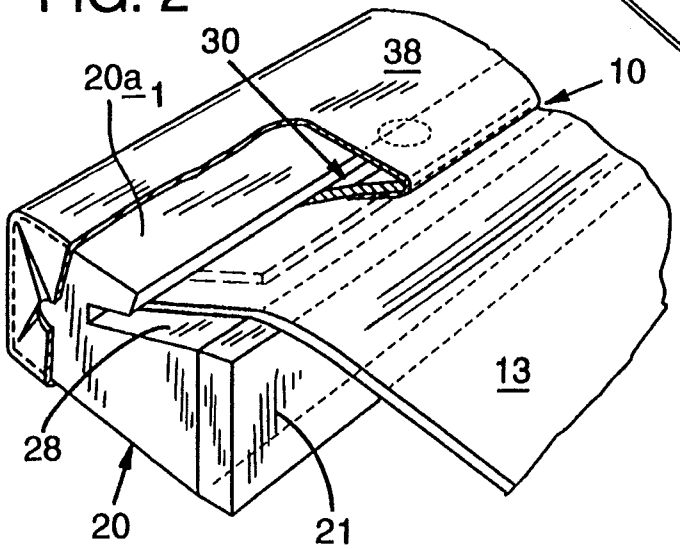
FIG. 2 is an inverted, enlarged fragmentary view of a section of the LMT shown in FIG. 1 with portions broken away to show details of the invention.
Figure 3:
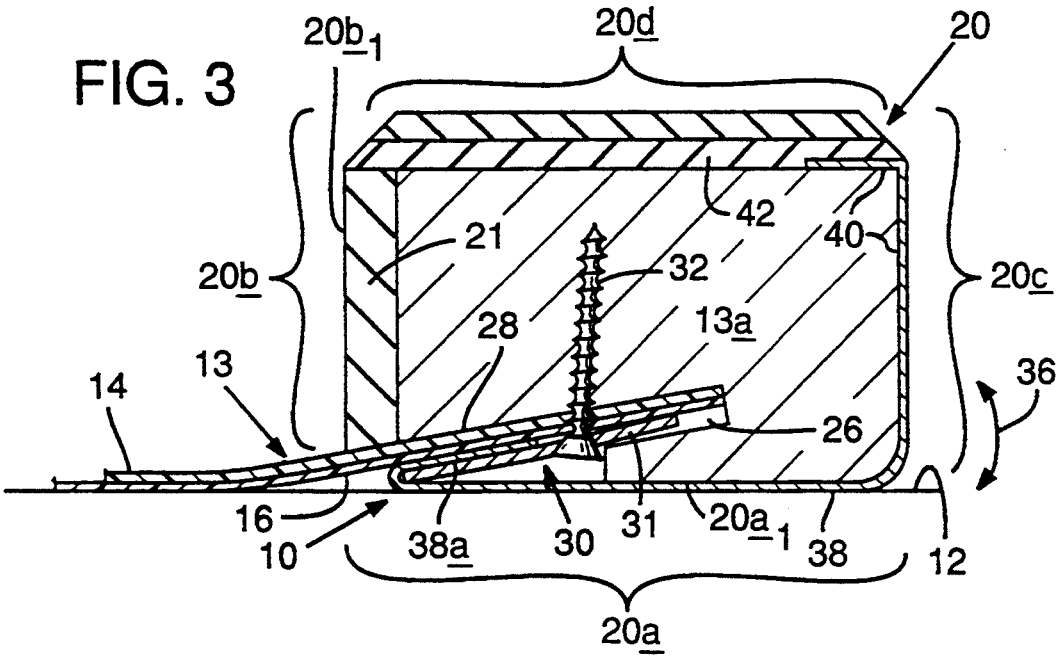
FIG. 3 is a side-sectional view through line 3—3 of FIG. 1.

Still referring to FIG. 1, the LMT also includes opposing bumpers 20 each being attached with assembly 10 to a first end of the slideboard. Referring to FIGS. 2–3, each bumper 20 has a bottom region 20*a* with a bottom surface $20a_1$, an inner region 20*b* with an impact surface $20b_1$, an outer region 20*c*, a top region 20*d*, and opposing end regions one of which is shown at 20*e* in FIG. 4. Suitably attached to inner region 20*b* and terminating with impact surface $20b_1$ is a shock absorbing pad 21, which is preferably manufactured from foam rubber. It should be understood that where details of one bumper are described below, the opposing, or second, bumper attached to a second end would have the same construction.

Still referring to FIGS. 2–3 details of assembly 10 will now be described. The assembly includes slideboard-receiving structure 26 formed in bottom region 20*a* at an angle that slopes upwardly with respect to the bottom region and away from impact surface $20b_1$. Preferably, slideboard-receiving structure 26 includes a to-be-described, upwardly angled groove formed in bottom region 20*a*, and including a groove surface 28.

Assembly 10 also includes slideboard-fastening structure 30 positionable adjacent slideboard-receiving structure 26 and operative to fasten a first end 13*a* of slideboard 13 to bottom region 20*a*. Preferably, slideboard-fastening structure 30 includes a pressure plate 31 and fastening devices one of which is shown at 32. The pressure plate may be made of any suitable material such as metal and the fastening devices may be screws or other suitable devices.

Referring again to FIG. 3, the groove associated with slideboard-receiving structure 26 is preferably formed at an angle (indicated at 36) of about 15°–30° relative to a plane containing bottom surface $20a_1$.

Referring to FIGS. 2–3, assembly 10 also includes a protective-decorative covering 38 for bottom region 20*a*. The covering includes a first edge 38*a* for inserting in slideboard-receiving structure 26 between slideboard-fastening structure 30 and pad 16 to fix the position of first edge 38*a* when bumper 20 is attached to slideboard 13. The remainder of covering 38 is structured for folding back over bottom region 20*a* and further includes a fastener 40 (preferably double-sided adhesive tape) for fixing the remainder to the bumper. Also, the remainder of covering 38 is preferably structured to cover bottom region 20*a* and outer region 20*c*.

Figure 4:
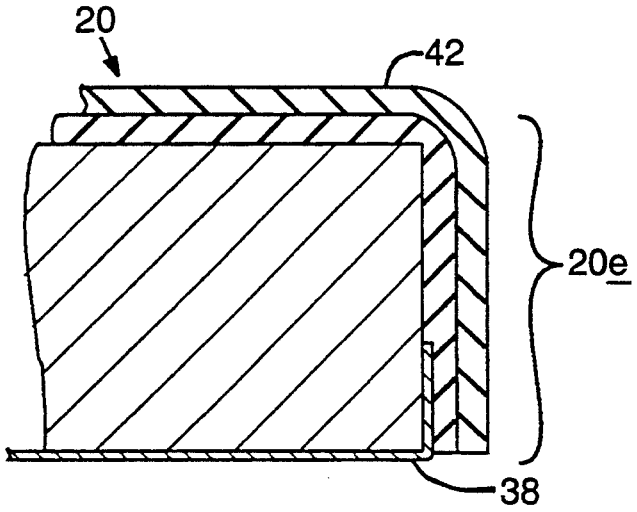
FIG. 4 is an end-sectional view through line 4—4 of FIG. 1.

Referring to FIGS. 3–4, assembly 10 also includes a two-ply, protective-decorative strip 42 fixedly applied to bumper 20 to cover the ends and top of the bumper, to provide an attractive appearance for bumper 20, and to secure further protective-decorative covering 38.

Figure 5:
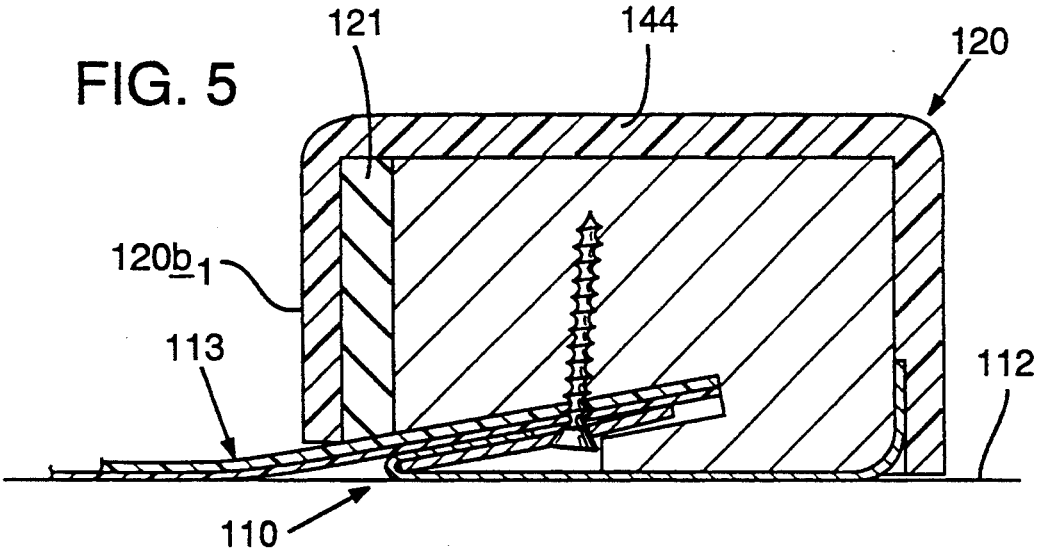
FIG. 5 is like FIG. 3 but shows a second embodiment of the invention.

Referring to FIG. 5, another embodiment of the invention is shown that includes a protective-decorative cap 144 being structured to cover the top, inner, outer and end regions of the bumper 120.

OPERATION

Referring to FIGS. 2–3, the bumper-attachment assembly of the present invention is used by inserting first edge 13*a* of slideboard 13 into slideboard-receiving structure 26 so that it rests in the groove. Slideboard-fastening structure 30 is used to fasten bumper 20 to slideboard 13 by sandwiching first edge 13*a* between groove surface 28 and pressure plate 31, and driving screws such as screw 32 through the same and into bumper 20.

Still referring to FIGS. 2–3, protective-decorative covering 38 is attached to the assembly by inserting first edge 38*a* into slideboard-receiving structure 26 between pressure plate 31 and pad 16 to fix the position of the first edge when the bumper is attached to the slideboard. The remainder of covering 38 is folded back over bottom region 20*a* and fixed to bumper 20 via double-sided adhesive tape 40.

Referring to FIGS. 3–5, protective-decorative strip 42 (FIGS. 3–4) or protective-decorative cap 144 (FIG. 5) are suitably applied, via adhesive for example, to bumper 20.

Assembly 10 achieves the objects of overcoming the drawbacks of prior art assemblies because slideboard-receiving structure 26 and slideboard-fastening structure 30 tend to downwardly bias bumper 20, particularly inner region 20*b* with respect to slideboard 13. The result is that assembly 10 tends to maintain inner impact surface $20b_1$ of each bumper 20 in the desired position normal to a plane containing the slideboard.

Figure 6:
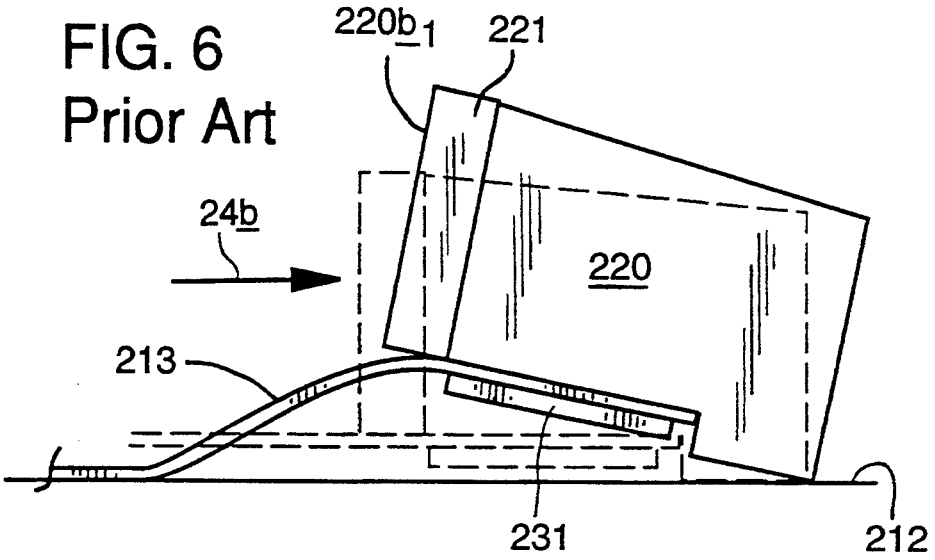
FIG. 6 Prior Art
FIG. 6 is a fragmentary, side-elevational view of one end of a prior art LMT, showing a bumper and slideboard in a first desired position in dashed lines, and showing a somewhat exaggerated view of the same LMT in a second undesired position in solid lines.

Referring to FIG. 6, a portion of a prior art LMT is shown in two positions to illustrate the drawbacks of conventional devices, and to help the reader understand further how the present invention overcomes them. The conventional LMT rests on a floor 212 and includes a slideboard 213 with an attached bumper 220. Bumper 220 is attached to slideboard 213 by sandwiching an end of the slideboard between pressure plate 231 and the bottom of the slideboard. Suitable screws (undepicted) are then placed through corresponding holes (undepicted) in the plate and slideboard, and driven into the bumper to complete the bumper attachment.

Still referring to FIG. 6, when the conventional LMT is used by an athlete, the athlete's sideways leg force 246 is exerted on bumper 220 via impact surface 220$b_1$ of shock absorbing pad 221. Bumper 220 assumes a canted position (solid lines) with respect to slideboard 213 because the force exerted on the bumpers by the athlete causes slideboard 213 to flex upwardly underneath bumper 220. This flexing causes bumper 220 to rock outwardly and rest on its outer edge. The result is that impact surface 220$b_1$ is positioned greater than 90° with respect to the slideboard.

By using the present invention to attach a bumper to a slideboard, it has been found that the attached bumper tends to maintain the desired position of impact surface 220$b_1$ substantially normal to a plane containing slideboard 13 (FIG. 3).

Also, using the present invention with its protective-decorative covering to attach bumpers to an LMT will not adversely affect wood or other floors when the LMT is used. It will also provide the LMT with an attractive appearance.

While the present invention has been shown and described with reference to the foregoing preferred embodiment, it will be apparent to those skilled in the art that other changes in form and detail may be made therein without departing from the spirit and scope of the invention as defined in the appended claims.

What is claimed is:

1. An improved lateral movement trainer comprising:

an elongate slideboard;

opposing one-piece bumpers, each being attached to a, corresponding end of the slideboard, wherein each bumper includes an inner region with an impact surface, outer and top regions, and a bottom region that includes a bottom surface, and wherein each bumper is formed with a groove for receiving a corresponding end the slideboard with the groove being formed at an angle that slopes upwardly with respect to the bottom surface and away from the impact surface; and slideboard-fastening structure positionable adjacent the groove of each bumper, and being operative to fasten a corresponding end of the slideboard to the bottom region.

2. The lateral movement trainer of claim 1 wherein the groove is formed at an angle of about 15°–30° sloping upwardly from a plane containing the bottom surface of the bottom region.

3. The lateral movement trainer of claim 1 further including a protective-decorative covering for the bottom region, which covering includes a first edge for inserting in the slideboard-receiving structure between the slideboard-fastening structure and the bottom of the slideboard to fix the position of the first edge when the bumper is attached to the slideboard, and wherein the remainder of the covering is structured for folding back over the bottom region and further includes a fastener for fixing it to the bumper.

4. The lateral movement trainer of claim 3, wherein the remainder of the covering is structured to cover the bottom region and the outer region, and the fastener is structured to fix the covering thereto.

5. The lateral movement trainer of claim 3 further including a protective-decorative cap that is structured to cover the top, inner and outer regions of the bumper.

6. A lateral movement trainer with an improved bumper-attachment assembly comprising:

an elongate slideboard;

opposing one-piece bumpers, each being attached to a corresponding end of the slideboard, wherein each bumper includes an inner region with an impact surface, and a bottom region having a bottom surface and being formed with a groove for receiving a corresponding end of the slideboard;

slideboard-fastening structure positionable adjacent the groove of each bumper and being operative to fasten a corresponding end of the slideboard to the bottom region; and a protective-decorative covering for at least the bottom region of each bumper, which covering includes a first edge for inserting in the groove of each bumper under the corresponding end of the slideboard, for fastening to the bumper with the slideboard, thereby to fix the position of the first edge when the bumper is attached to the slideboard, and wherein the remainder of the covering is structured for folding back over the bottom surface and further includes a fastener for fixing it to the bumper.

7. The assembly of claim 6, wherein the remainder of the covering is structured to cover the bottom region and the outer region, and the fastener is structured to fix the covering thereto.

8. The assembly of claim 6 further including a protective-decorative cap that is structured to cover the top, inner and outer regions of the bumper.

9. The assembly of claim 7 further including a protective-decorative cap that is structured to cover the top, inner and outer regions of the bumper.

* * * * *